US009004329B2

(12) United States Patent
Hsieh et al.

(10) Patent No.: US 9,004,329 B2
(45) Date of Patent: Apr. 14, 2015

(54) WEARABLE DEVICE

(75) Inventors: Fang-Keng Hsieh, New Taipei (TW); Yi-Ping Zhou, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 331 days.

(21) Appl. No.: 13/455,147

(22) Filed: Apr. 25, 2012

(65) Prior Publication Data

US 2013/0152276 A1 Jun. 20, 2013

(30) Foreign Application Priority Data

Dec. 20, 2011 (CN) ..... 2011 1 0429288

(51) Int. Cl.

| | |
|---|---|
| ***A44C 5/00*** | (2006.01) |
| ***A45F 5/00*** | (2006.01) |
| ***G04B 37/14*** | (2006.01) |
| ***G04G 17/08*** | (2006.01) |

(52) U.S. Cl.

CPC ..... *G04B 37/1486* (2013.01); *G04G 17/08* (2013.01); *Y10S 224/93* (2013.01)

(58) Field of Classification Search

CPC ..... G04B 37/00; G04B 37/04; G04G 17/08

USPC ..... 224/164–179, 219, 221, 242, 245, 247, 224/930; 368/281

See application file for complete search history.

(56) References Cited

U.S. PATENT DOCUMENTS

| | | | | |
|---|---|---|---|---|
| 1,523,358 | A * | 1/1925 | Lasko | 368/281 |
| 4,217,681 | A * | 8/1980 | Grohoski et al. | 24/265 WS |
| 5,392,261 | A * | 2/1995 | Hsu | 368/281 |
| 5,638,342 | A * | 6/1997 | Kartsotis et al. | 368/282 |
| 5,657,298 | A * | 8/1997 | Choay | 368/276 |
| 5,899,370 | A * | 5/1999 | Bould | 224/175 |
| 6,886,724 | B2 * | 5/2005 | Hung | 224/163 |
| 6,971,789 | B2 * | 12/2005 | Nakamura | 368/300 |
| 7,226,321 | B2 * | 6/2007 | Uhari | 439/752 |
| 7,507,017 | B2 * | 3/2009 | Chevalier et al. | 368/281 |
| 7,553,069 | B2 * | 6/2009 | Gibbons | 368/282 |
| 8,292,493 | B2 * | 10/2012 | Mooring | 368/276 |
| 8,345,412 | B2 * | 1/2013 | Maravilla et al. | 361/679.03 |
| 8,506,158 | B2 * | 8/2013 | Keung et al. | 368/282 |
| 8,534,514 | B2 * | 9/2013 | Zhu et al. | 224/165 |
| 2006/0171261 | A1 * | 8/2006 | Ruchonnet | 368/281 |
| 2007/0253290 | A1 * | 11/2007 | Aire | 368/294 |
| 2009/0196124 | A1 * | 8/2009 | Mooring | 368/204 |
| 2009/0257323 | A1 * | 10/2009 | Soltani | 368/281 |
| 2010/0302913 | A1 * | 12/2010 | Loiseau | 368/281 |

FOREIGN PATENT DOCUMENTS

| | | |
|---|---|---|
| CN | 202057972 U | 11/2011 |
| TW | 558050 U | 10/2003 |
| TW | M319432 | 9/2007 |
| TW | M339018 | 8/2008 |

* cited by examiner

*Primary Examiner* — Justin Larson

(74) *Attorney, Agent, or Firm* — Novak Druce Connolly Bove + Quigg LLP

(57) ABSTRACT

A wearable device includes a main body, a housing, and two connection elements fixed to the housing. The connection element includes a body and at least one elastic protrusion protruding from one side of the body. When mounting the main body to the housing, the elastic protrusion of the connection element is deformed to generate elastic force to fix the main body to the housing.

17 Claims, 4 Drawing Sheets

WEARABLE DEVICE

BACKGROUND

1. Technical Field

The present disclosure relates to a wearable device and, particularly, to a connection structure between a body and a housing of the wearable device.

2. Description of Related Art

A main body and a housing of a conventional wearable device, such as a watch, are connected by screws. When the main body is detached or mounted to the housing, a tool such as screwdriver is needed, which is inconvenient for repair.

BRIEF DESCRIPTION OF THE DRAWINGS

The components of the drawings are not necessarily drawn to scale, the emphasis instead being placed upon clearly illustrating the principles of the present disclosure. Moreover, in the drawings, like reference numerals designate corresponding parts throughout several views.

DETAILED DESCRIPTION

Figure 1:
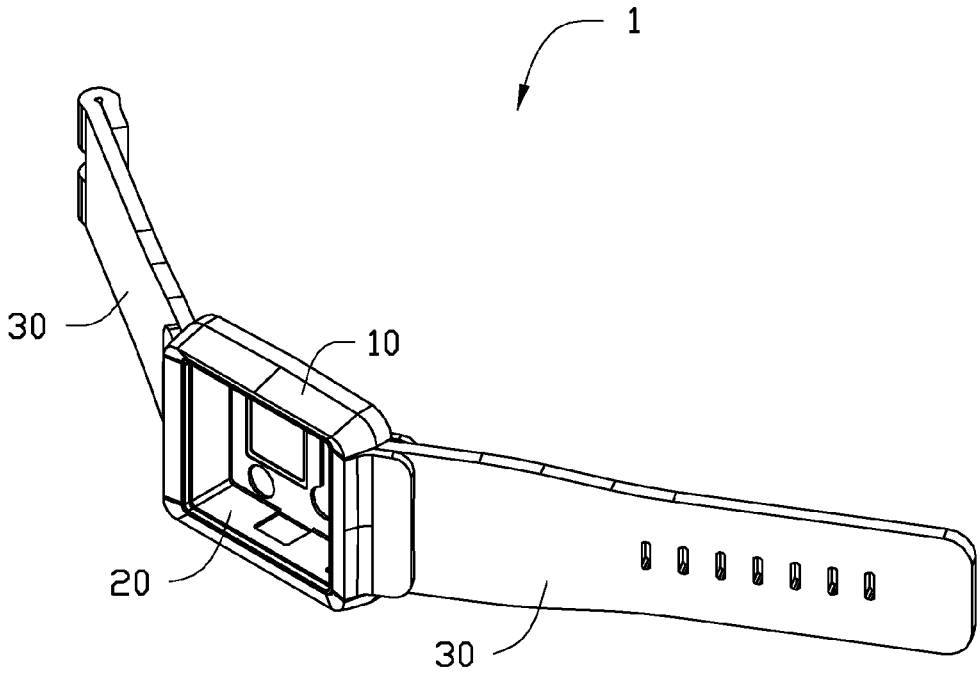
FIG. 1 is an isometric view of a wearable device in accordance with a first exemplary embodiment, with certain components omitted for simplicity of illustration.
Figure 2:
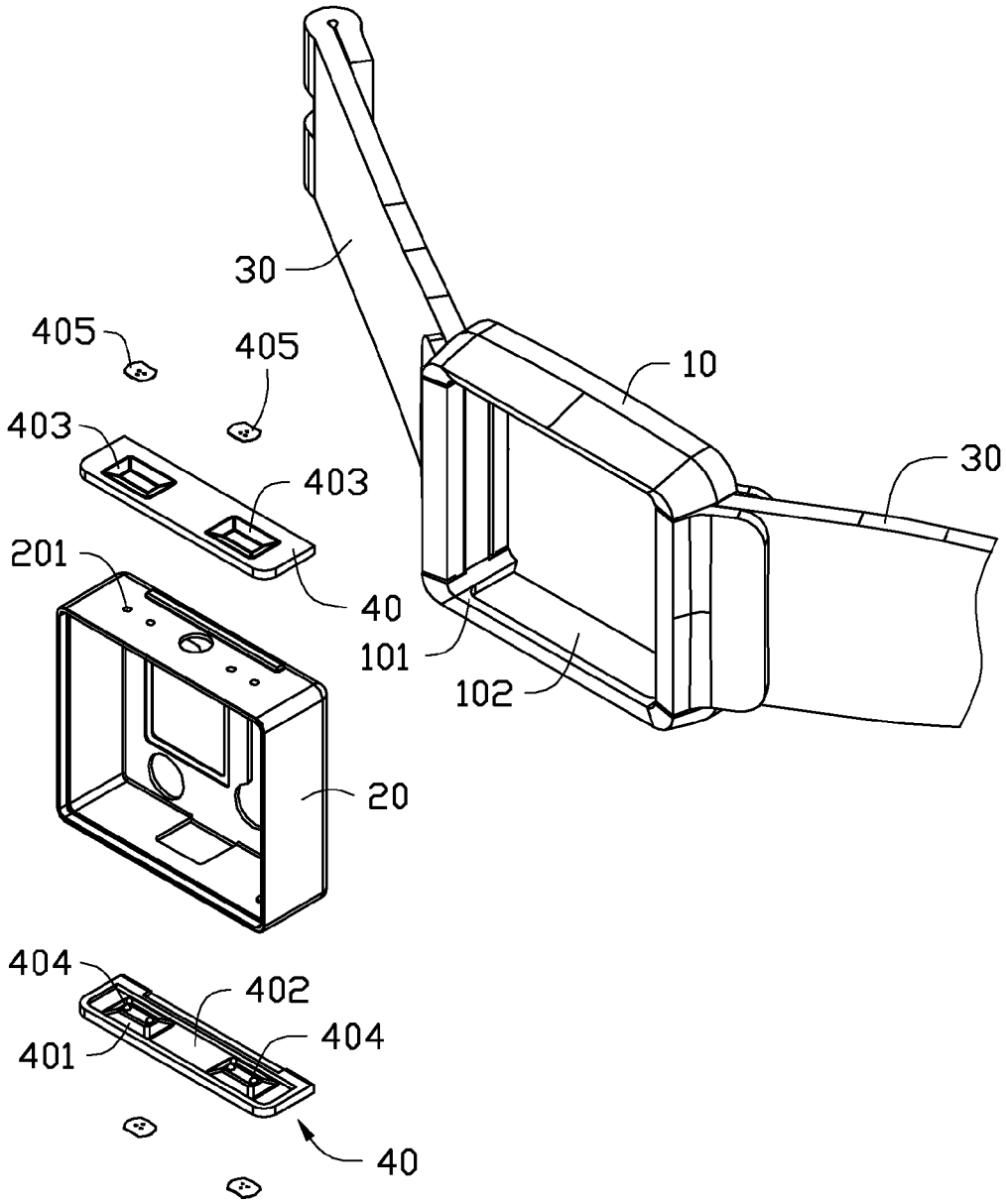
FIG. 2 is an explored view of the wearable device of FIG. 1.

FIGS. 1-2, show a wearable device 1 in a first embodiment including a main body 10, a housing 20, and a strap such as a wrist band 30. The main body 10 is mounted to the housing 20 by a first connection element 40. The wrist band 30 is fixed to two ends of the housing 20. The wearable device 1 can be worn on wrist or, using other straps, can be worn on the ankle, or above the elbow, for example.

The wearable device 1 includes two first connection elements 40 each of which is respectively fixed to two opposite inner walls 101 of the housing 20. In the embodiment, the inner wall 101 defines two first recesses 102 for receiving the two first connection elements 40. The first connection element 40 includes at least one protrusion 401 and a body 402. In the embodiment, two protrusions 401 are formed, for example. Each protrusion 401 protrudes from one side of the body 402 and forms a second recess 403 on the other side of the body 402 and the side formed the second recess 403 is received in the first recess 102. In the embodiment, the side formed the second recess 403 is glued to the first recess 102 and the two protrusions 401 and the body 402 are double color molding, wherein the body 402 is made of plastic and the protrusion 401 is made of rubber.

When mounting the main body 20 to the housing 10, the protrusion 401 is deformed to generate elastic force to fix the main body 20 to the housing 10, thereby the main body 20 is mounted to the housing 10.

In the embodiment, in order to mount the main body 20 to the housing 10 steadily, a pole 404 is defined on the protrusion 401, a corresponding blind hole 201 matching the pole 404 is defined in the housing 20 to receive the pole 404, thereby the body 20 can be mounted steadily to the housing 10.

In the embodiment, each of the first connection element 40 includes at least one elastic element 405. One second recess

403 receives one elastic element 405. Thereby when the body 20 is mounted to the housing 10, the elastic element 405 is deformed to allow the body 20 to be mounted to the housing 10 firmly. In the embodiment, the elastic element is arc shaped and is made of stainless steel.

Figure 3:
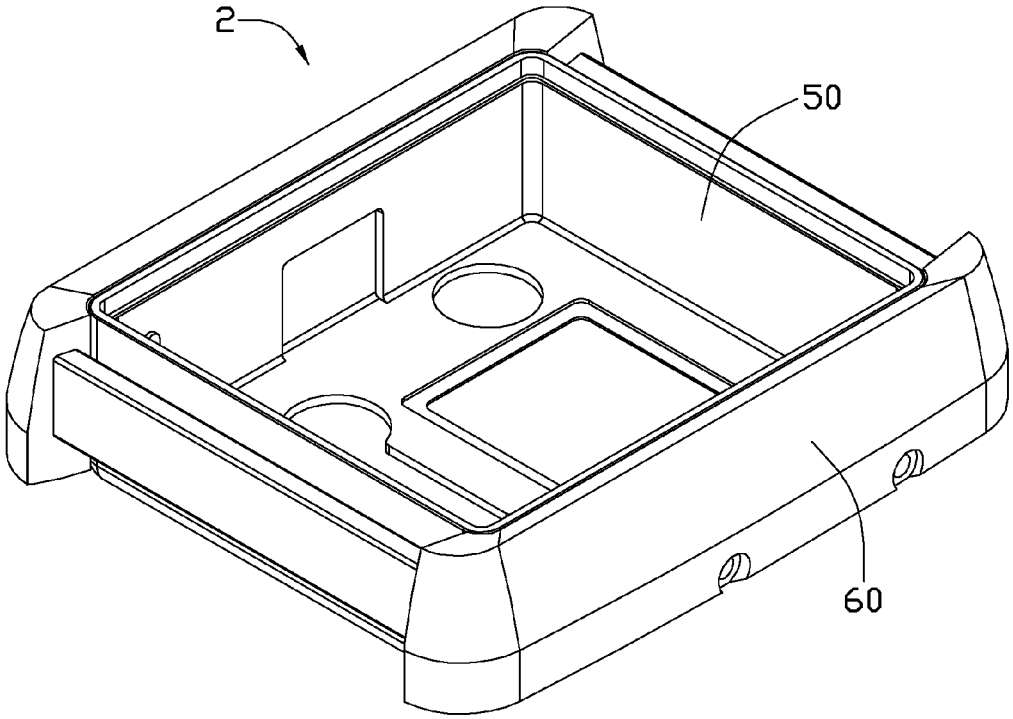
FIG. 3 is an isometric view of a wearable device in accordance with a second exemplary embodiment, with certain components omitted for simplicity of illustration.
Figure 4:
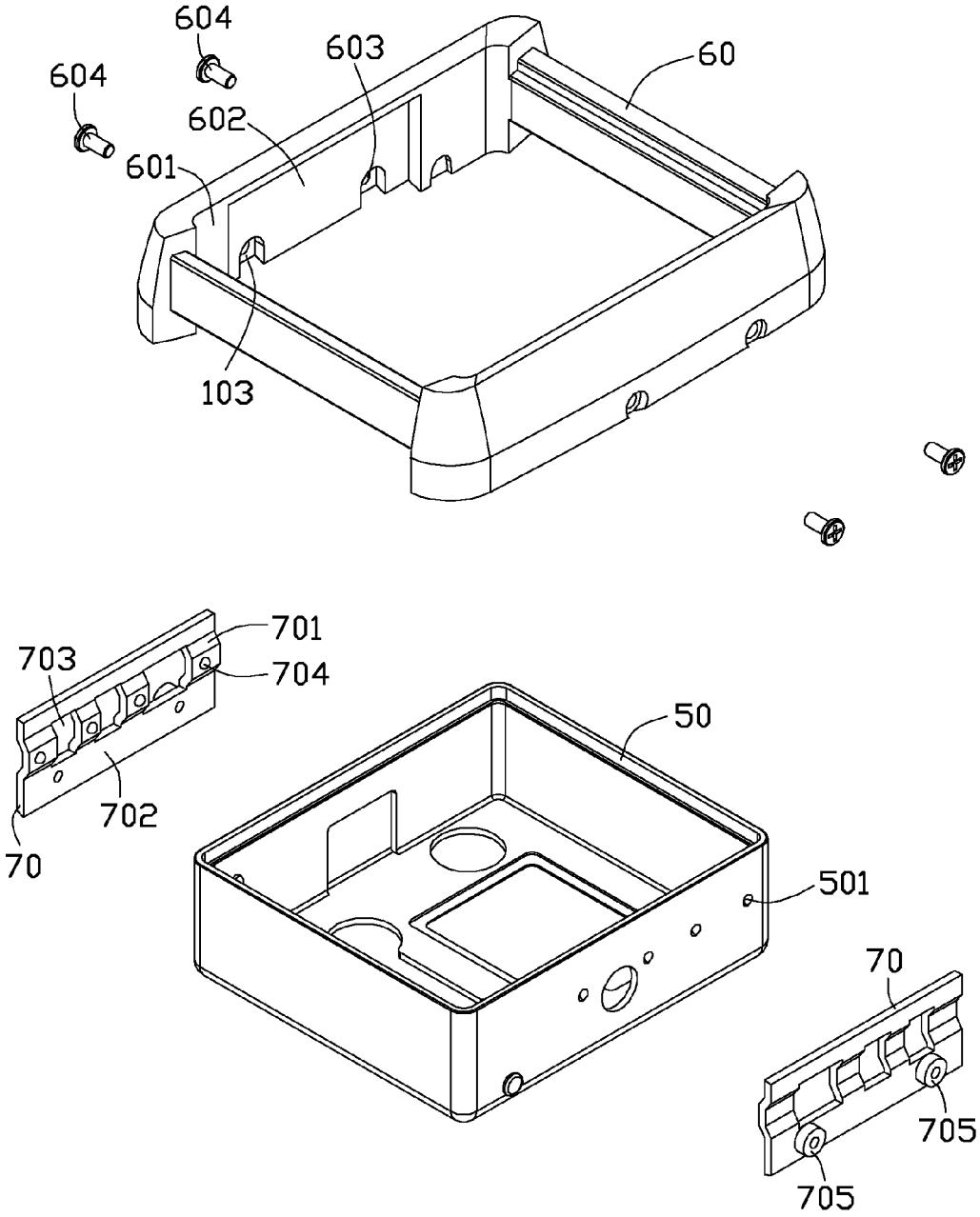
FIG. 4 is an explored view of the wearable device of FIG. 3.

Referring to FIGS. 3-4, the wearable device 2 in a second embodiment includes a main body 50 and a housing 60. The main body 50 is mounted to the housing 60 using a second connection element 70.

The wearable device 2 includes two second connection elements 70 respectively fixed to two opposite inner walls 601 of the housing 60. In the embodiment, the inner wall 601 defines two recesses 602 for receiving the two second connection elements 70. The two second connection elements 70 are made of metal, such as copper foil.

The bottom of each of the two recesses 602 defines two first holes 603, the second connection elements 70 defines two screw holes 704, each of the two screws 604 passes through one of the first hole 603 and one of the two screw holes 704 to fix the second connection element 70 to the housing 60.

Each second connection element 70 includes at least one elastic protrusion 701 and a body 702. The elastic protrusion 701 protrudes from one side of the body 702. Two adjacent elastic protrusions 701 are separated by a second hole 703. In the embodiment, each second connection element 70 includes four elastic protrusions 701.

When mounting to the main body 50 to the housing 60, the elastic protrusions 701 are deformed to generate elastic force to fix the body 50 to the housing 60.

In the embodiment, in order to mount the main body 50 to the housing 60 steadily, a pole 704 is defined on the protrusion 701, a corresponding blind hole 501 matching the pole 704 is defined on the housing 60 receiving the pole 704, thereby the main body 70 is mounted steadily to the housing 60.

Although, the present disclosure has been specifically described on the basis of preferred embodiments, the disclosure is not to be construed as being limited thereto. Various changes or modifications may be made to the embodiment without departing from the scope and spirit of the disclosure.

What is claimed is:

1. A wearable device comprising:

a main body;

a housing; and at least one connection element fixed to the housing, each of the at least one connection element comprising:

a body; and at least one elastic protrusion protruding from one side of the body, wherein the at least one elastic protrusion and the body are double color molded, the body is made of plastic and the at least one protrusion is made of rubber;

wherein when mounting the main body to the housing, the at least one elastic protrusion of each of the at least one connection element is deformed to generate elastic force to fix the main body in the housing.

2. The wearable device as described in claim 1, wherein the number of the at least one connection element is two and the two connection elements are respectively fixed to two opposite inner walls of the housing.

3. The wearable device as described in claim 2, wherein the inner wall of the housing defines two first recesses for respectively receiving the two connection elements.

4. The wearable device as described in claim 1, wherein each of the at least one connection element is fixed to the housing by gluing the at least one connection element to the housing.

5. The wearable device as described in claim 1, wherein a pole is defined on the at least one elastic protrusion, a corresponding blind hole matching the pole is defined on the housing to receive the pole.

6. The wearable device as described in claim 1, wherein each of the at least one elastic protrusion forms a recess on an opposite side of the body, the at least one connection element includes at least one elastic element, one of the at least one recess receives one of the at least one elastic element.

7. The wearable device as described in claim 6, wherein each of the elastic element is arc shaped and is made of stainless steel.

8. A wearable device comprising:

a main body;

a housing; and at least one connection element fixed to the housing, each of the at least one connection element comprising:

a body; and at least one elastic protrusion protruding from one side of the body, each of the at least one elastic protrusion forms a recess on an opposite side of the body; and at least one elastic element, one of the at least one recess receiving one of the at least one elastic element;

wherein when mounting the main body to the housing, the at least one elastic element of each of the at least one connection element is deformed to generate elastic force to fix the main body in the housing.

9. The wearable device as described in claim 8, wherein the number of the at least one connection element is two and the two connection elements respectively fixed to two opposite inner walls of the housing.

10. The wearable device as described in claim 9, wherein the inner wall of the housing defines two first recesses for respectively receiving the two connection elements.

11. The wearable device as described in claim 8, wherein each of the at least one connection element is fixed to the housing by gluing the at least one connection element to the housing.

12. The wearable device as described in claim 8, wherein the at least one elastic protrusion and the body are double color molding, the body is made of plastic and the at least one protrusion is made of rubber.

13. The wearable device as described in claim 8, wherein a pole is defined on the at least one elastic protrusion, a corresponding blind hole matching the pole is defined on the housing to receive the pole.

14. A wearable device comprising:

a main body;

a housing comprising an inner wall, the inner wall defining two recesses, a bottom of each of the two recesses defining at least one holes; and at least one connection element defining at least one screw hole, at least one screw passing through the at least one hole and the at least one screw hole to fix the connection element to the housing, the at least one connection element being made of metal, each of the at least one connection element comprising:

a body; and at least one elastic protrusion protruding from one side of the body;

wherein when mounting the main body to the housing, the at least one elastic element protrusion of each of the at least one connection element is deformed to generate elastic force to fix the main body in the housing.

15. The wearable device as described in claim 10, wherein the metal is copper foil.

16. The wearable device as described in claim 10, wherein two adjacent elastic protrusions protruding from the connection element are separated by a second hole.

17. The wearable device as described in claim 10, wherein the number of the at least one elastic protrusion comprised in each of the at least one connection element is four.

* * * * *